United States Patent [19]

Norris et al.

[11] Patent Number: 4,662,560

[45] Date of Patent: May 5, 1987

[54] SYSTEM FOR CONTROLLING ABSOLUTE HUMIDITY IN A WORK AREA

[75] Inventors: Paul K. Norris, Cusseta, Ala.; Perry S. Oliver, Atlanta, Ga.

[73] Assignee: West Point Pepperell, Inc., West Point, Ga.

[21] Appl. No.: 779,685

[22] Filed: Sep. 24, 1985

[51] Int. Cl.[4] ..... B01F 3/02

[52] U.S. Cl. ..... 236/44 B; 62/176.4; 165/12

[58] Field of Search ..... 236/44 B, 44 C; 165/22; 364/137; 62/176.4

[56] References Cited

U.S. PATENT DOCUMENTS 2,268,442 12/1941 Crawford ..... 165/20 X
2,953,355 9/1960 Hungate ..... 165/20
3,277,954 10/1966 Meckler ..... 165/20
4,312,189 1/1982 Cotton, Jr. ..... 236/44 A

OTHER PUBLICATIONS

Anderson, Instrumentation for Process Measurement & Control, 1974, pp. 158–159–Cascade Control.

*Primary Examiner*—William E. Wayner
*Attorney, Agent, or Firm*—Cushman, Darby & Cushman

[57] ABSTRACT

An absolute humidity sensor and a thermostat are located in an area where humidity and temperature are to be controlled. Air from this area is circulated through an air washer having a dry bulb temperature sensor at its discharge. Output signals from the absolute humidity and dry bulb temperature sensors are utilized to operate the air washer to control the moisture content of its discharge air. The thermostat operates a bypass damper to control the amount of circulating air which passes through the washer.

6 Claims, 2 Drawing Figures

SYSTEM FOR CONTROLLING ABSOLUTE HUMIDITY IN A WORK AREA

BACKGROUND

It has long been recognized that the control of temperature and humidity conditions in certain work areas is desirable to achieve efficient operation. This is particularly so in the textile industry, for example, where large rooms typically contain a vast amount of equipment employed to process materials which are highly sensitive to ambient conditions.

One system which has been developed to control the absolute humidity in a designated area is disclosed in U.S. Pat. No. 4,312,189 which issued to Worth B. Cotton, Jr., on Jan. 26, 1982. In this patent, there is disclosed an arrangement wherein a conventional air washer is utilized in the circulation path of the air being treated. An absolute humidity sensor is positioned in the output path from the air washer, and a dry bulb thermostat is located in the area being controlled. The absolute humidity sensor operates dampers to adjustably mix fresh air with air being returned from the controlled area to an air washer. The dry bulb thermostat controls a valve in the air washer to vary the amount of water sprayed into the return air/fresh air mixture. By this arrangement, the temperature and absolute humidity conditions of the air reaching the controlled area are established.

While the system disclosed in U.S. Pat. No. 4,312,189 is a useful one, it suffers certain shortcomings. For example, the absolute humidity sensor located at the air washer's output measures absolute humidity at only a small spot. However, the absolute humidity level typically varies across the substantial surface area of the air washer. Consequently, the sensor may not provide an accurate reading of the average absolute humidity of the air discharged from the washer. Furthermore, there are many textile operations in which a large room is divided—without partitions—into zones controlled at different temperatures and relative humidities. In such a situation, some migration occurs from zone to zone which cannot be accurately compensated for by absolute humidity sensors provided at the discharges of the separate air washers which service the respective zones.

SUMMARY OF THE INVENTION

The present invention represents an improvement in absolute humidity control systems accomplished by locating both an absolute humidity sensor and a thermostat in the area being controlled, and a dry bulb temperature sensor at the discharge of an air washer which services the controlled area.

The outputs of the absolute humidity and dry bulb temperature sensors are utilized to operate the air washer so that the moisture content of its discharge air is controlled. The thermostat in the controlled area operates a bypass damper which determines how much of the circulating air passes through the washer.

DETAILED DESCRIPTION OF THE INVENTION

The invention now will be described in greater detail with reference to the accompanying drawings which illustrates, in block diagram fashion, the basic components of the improved system. More particularly:

Figure 1:
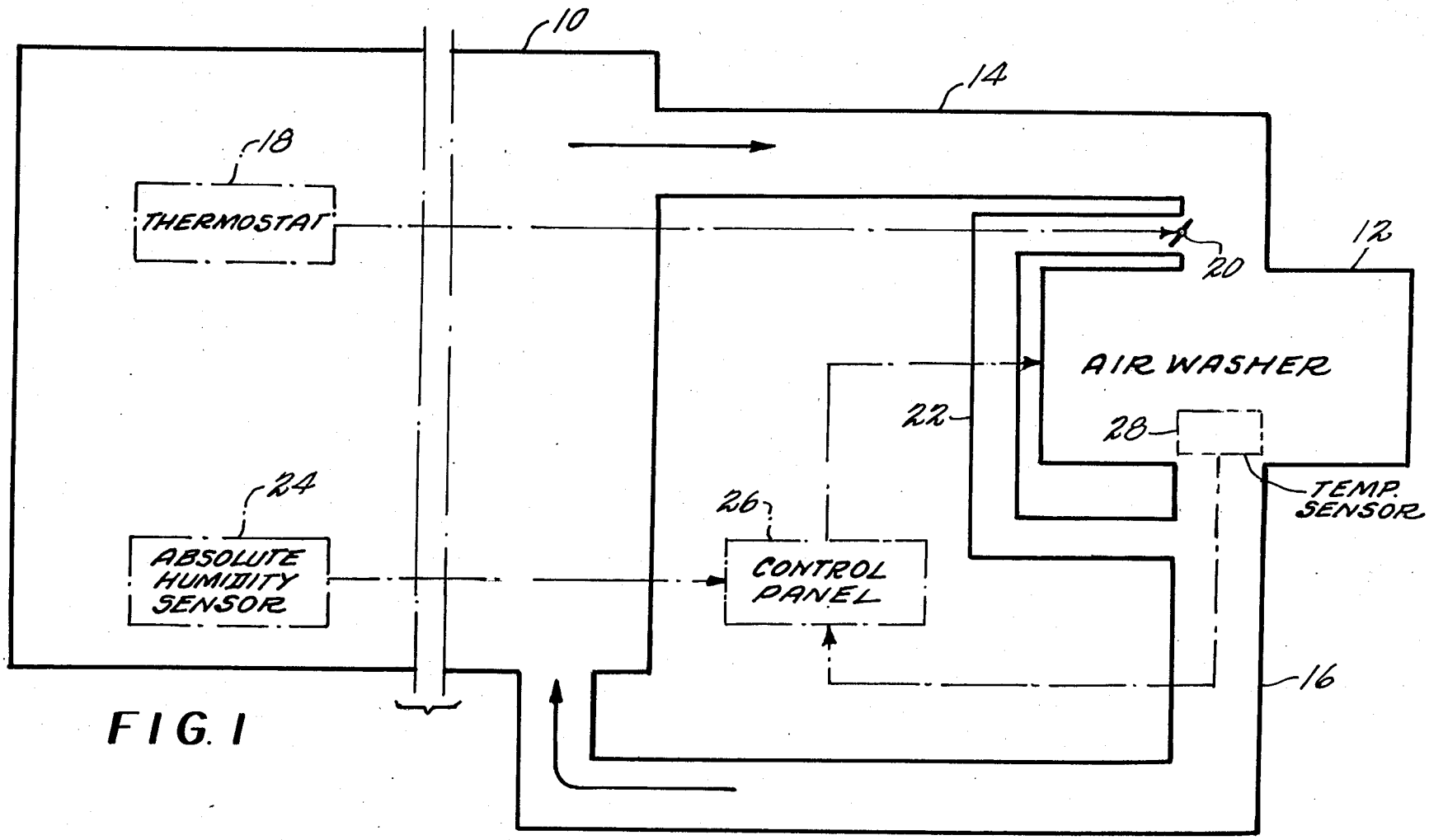
FIG. 1 illustrates the system in its entirety.

Referring to FIG. 1, the numeral 10 represents an area which is to be supplied with air which must be precisely controlled both as to temperature and absolute humidity. It will be understood that the area 10 may either be an entire room or a zone within a large room. In the latter case, instead of a single air washer 12 being employed, a separate washer is used for each zone.

The washer 12 is a conventional type which receives air from area 10 via a duct 14. After conditioning, the air is returned via a duct 16 to the controlled area.

Within area 10 a thermostat 18 is provided. This thermostat is operatively associated with a bypass damper 20 so as to selectively direct some of the circulating air through a duct 22 to bypass the air washer 12.

An absolute humidity sensor 24 also is located within the area 10. A suitable conventionally available sensor is the SCS-klimo Model FK-L75 which utilizes a hygroscopic salt, such as lithium chloride, which absorbs water from the air to vary its conductivity to thereby produce an output signal related to the absolute humidity of the air to which the sensor is exposed.

Figure 2:
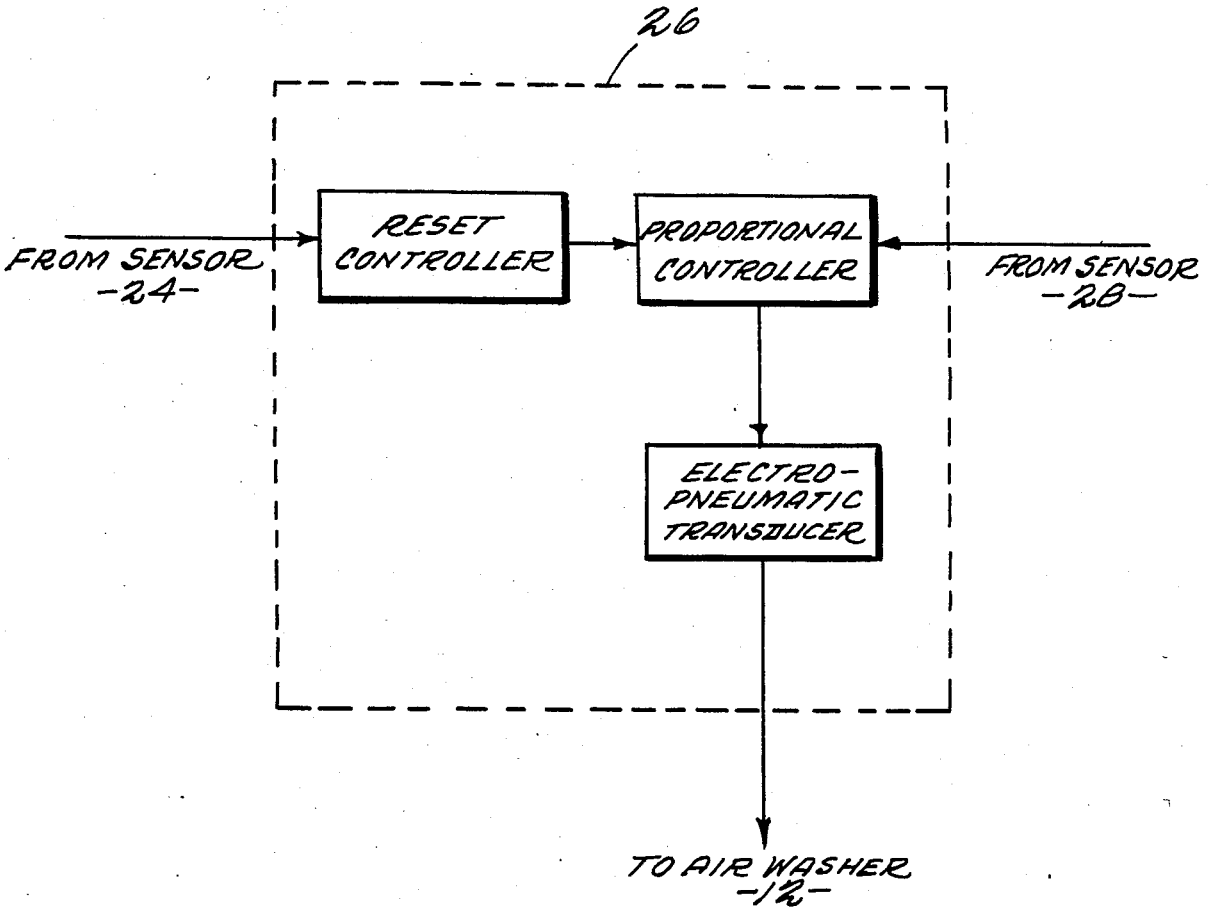
FIG. 2 illustrates components which are included in the control panel shown in FIG. 1.

The signal developed by sensor 24 is supplied to a control panel 26. A suitable control panel (shown in FIG. 2) consists of conventionally available devices including a proportional controller to produce a variable dc output signal, a reset controller which allows the control point of the proportional controller to be raised or lowered, and a transducer which converts the electrical signal from the proportional controller to a pneumatic signal for changing the operation of the air washer.

An available proportional controller is the SCS-klimo Model RFK 9 PDPI which compares a setpoint in a measuring loop with a sensed signal to develop an output signal proportional to the difference between the sensed signal and the setpoint.

A reset controller which is available to establish the setpoint of the proportional controller is the SCS-klimo Model WSU1. This controller is responsive to the signal generated by absolute humidity sensor 24 to determine the level of the setpoint.

The conversion of the output signal from the proportional controller to a pneumatic control signal can be accomplished by the commercially available SCS-klimo Model UFP electro-pneumatic transducer.

The signal which is compared with the setpoint of the proportional controller is one developed by a dry bulb temperature sensor 28 positioned in the discharge air plenum portion of washer 12. A suitable sensor which is commercially available for this application is the SCS-klimo Model FD-N30 which is particularly useful in sensing the average temperature in ducts with a large cross-section where non-uniform temperature distribution is likely to be experienced.

In operation, thermostat 18 in area 10 maintains the desired temperature by controlling the bypass damper 20. When the temperature decreases in area 10, the damper 20 opens to divert more air through duct 22 thereby reducing the amount of air being cooled by the air washer 12. Should the temperature in area 10 increase above that called for by the thermostat, damper 20 closes to increase the amount of air cooled by the washer.

The setpoint of the proportional controller determines the absolute humidity level within area 10. When the absolute humidity starts to rise, the signal developed by the absolute humidity sensor 24 alters the setpoint whereby the difference between the output signal from the temperature sensor 28 and the setpoint produces an output signal from the proportional control which is converted to a pneumatic signal which in turn controls the chill water valve or air mixing dampers of washer 12 to reduce the dry bulb discharge temperature of the washer and thus the moisture content of air returned to area 10 via duct 16. Conversely, when the absolute humidity in area 10 starts to fall, the change in the controller's setpoint results in the dry bulb discharge temperature being raised whereby the moisture content of the air returned to area 10 is increased.

By the arrangement which has been described, a precise control of absolute humidity and temperature within an area can be maintained in spite of infiltration of outside air, changes in barometric pressure, vapor migration from zone to zone, and the like.

What is claimed is:

1. A system for controlling absolute humidity of air which is removed from an area, passed through an air washer and returned through a duct to said area, the system comprising:

a first sensor located within the area for generating a first signal representative of the absolute humidity of air within said area;

a second sensor located in a discharge air plenum portion of the washer for generating a second signal representative of the dry bulb temperature of air discharged from the washer; and control means responsive to said first and second signals for producing a third signal which is applied to said washer to control the dry bulb temperature of air discharged from the washer.

2. A system as set forth in claim 1, wherein said control means comprises:

a proportional controller having a setpoint which is adjustable in response to the first signal, and means for comparing the setpoint with said second signal to produce said third signal.

3. A system as set forth in claim 2, wherein said first and second signals are electrical and wherein said comparison means produces an electrical output, the system further comprising:

an electrical to pneumatic transducer for converting said electrical output to a pneumatic signal which constitutes said third signal.

4. A system for controlling absolute humidity of air which is removed from an area, passed through an air washer and returned through a duct to said area, the system comprising:

a first sensor located within the area for generating a first signal representative of the absolute humidity of air within said area;

a second sensor located in a discharge air plenum portion of the washer for generating a second signal representative of the dry bulb temperature of air discharged from the washer;

control means responsive to said first and second signals for producing a third signal which is applied to said washer to control the dry bulb temperature of air discharged from the washer;

a thermostat located within said area for generating a fourth signal when the temperature of air within said area varies from a prescribed level;

an additional duct for bypassing the air washer whereby air is removed from the area and is returned by the return duct to said area; and damper means operated in response to said fourth signal for controlling the flow of air through said air washer and the additional duct.

5. A system as set forth in claim 4, wherein said control means comprises:

a proportional controller having a setpoint which is adjustable in response to the first signal, and means for comparing the setpoint with said second signal to produce said third signal.

6. A system as set forth in claim 5, wherein said first and second signals are electrical and wherein said comparison means produces an electrical output, the system further comprising:

an electrical to pneumatic transducer for converting said electrical output to a pneumatic signal which constitutes said third signal.

* * * * *

UNITED STATES PATENT AND TRADEMARK OFFICE

CERTIFICATE OF CORRECTION

PATENT NO. : 4,662,560

DATED : MAY 5, 1987

INVENTOR(S) : Paul K. Norris and Perry S. Oliver

It is certified that error appears in the above-identified patent and that said Letters Patent is hereby corrected as shown below:

On the first page of the patent, in the line designating the Assignee, in addition to "West Point Pepperell, Inc., West Point, Ga.", please include --and Oliver & Company, Inc., Atlanta, Ga. --

Signed and Sealed this

Eighth Day of December, 1987

*Attest:*

DONALD J. QUIGG

*Attesting Officer*

*Commissioner of Patents and Trademarks*